US010518192B1

(12) United States Patent
Swan

(10) Patent No.: US 10,518,192 B1
(45) Date of Patent: Dec. 31, 2019

(54) TURN-KEY DESIGN FOR CONNECTING A PLURALITY OF PLANAR SURFACES

(71) Applicant: Hobart Bemis Swan, Boise, ID (US)

(72) Inventor: Hobart Bemis Swan, Boise, ID (US)

(73) Assignee: Hobart Bemis Swan, Boise, ID (US)

( * ) Notice: Subject to any disclaimer, the term of this patent is extended or adjusted under 35 U.S.C. 154(b) by 0 days.

(21) Appl. No.: 16/044,993

(22) Filed: Sep. 24, 2018

(51) Int. Cl.
*A63H 33/10* (2006.01)
*A63H 33/00* (2006.01)
*A63H 33/04* (2006.01)

(52) U.S. Cl.
CPC ..... *A63H 33/106* (2013.01); *A63H 33/008* (2013.01); *A63H 33/04* (2013.01); *A63H 33/10* (2013.01)

(58) Field of Classification Search
CPC .... A63H 33/04; A63H 33/044; A63H 33/062; A63H 33/10; A63H 33/101; A63H 33/102; A63H 33/105; A63H 33/106; A63H 33/12
See application file for complete search history.

(56) References Cited

U.S. PATENT DOCUMENTS 1,890,269 A * 12/1932 Swanson ..... A63H 33/06 446/115
3,827,177 A * 8/1974 Wengel ..... A63H 33/101 446/112
3,855,748 A * 12/1974 Thomas ..... A63B 9/00 52/578
4,454,678 A * 6/1984 Duvivier ..... A63H 33/105 446/112
5,472,365 A * 12/1995 Engel ..... A63H 33/04 403/170
2002/0086605 A1* 7/2002 Cheung ..... A63H 33/062 446/124
2007/0085267 A1* 4/2007 Walsh ..... A63F 9/0413 273/146
2012/0000059 A1* 1/2012 Fox ..... F16B 2/20 29/525.01
2012/0282841 A1* 11/2012 Wei ..... A63H 33/101 446/118
2013/0230353 A1* 9/2013 Murphy ..... A63H 33/105 403/382

FOREIGN PATENT DOCUMENTS

GB 2530540 A * 3/2016 ..... A63H 33/008

* cited by examiner

*Primary Examiner* — Eugene L Kim
*Assistant Examiner* — Alyssa M Hylinski

(57) ABSTRACT

Most children's construction sets fail when to comes to providing children with a fast and easy way to build large structures, such as houses and forts. They fail because the methods they use to connect the pieces of the set are not feasible, don't enable the children to build large structure, or quickly damage the pieces themselves. This application represents years of refinement to produce a novel "turn-key" design that makes it very easy for children to build such structures—or any other large objects they can imagine. The novelty of this approach includes a slotted "Connecting Element" that users can slip between cutout made in the edges of "Planar Elements." The user inserts the Connecting Element, lines up the slots on the element with the edges of two adjacent Planar Elements, and then rotates the Connecting Element approximately 90 degrees to connect said Planar Elements using friction and compression.

2 Claims, 7 Drawing Sheets

View depicting the rotating action of the ""Turn-Key"" design

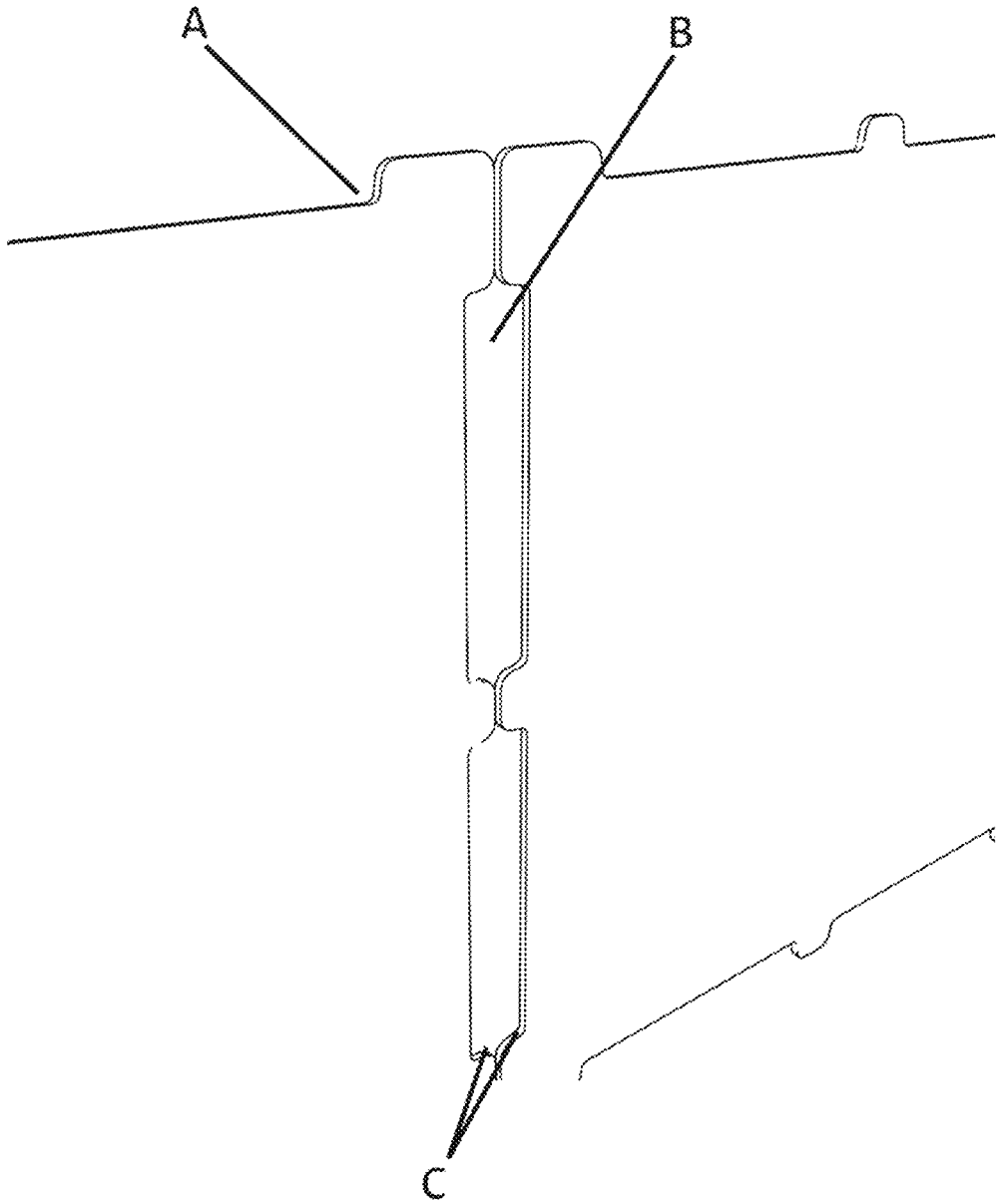
Fig. 1: View demonstrating the gap formed by cutouts in the Planar Elements

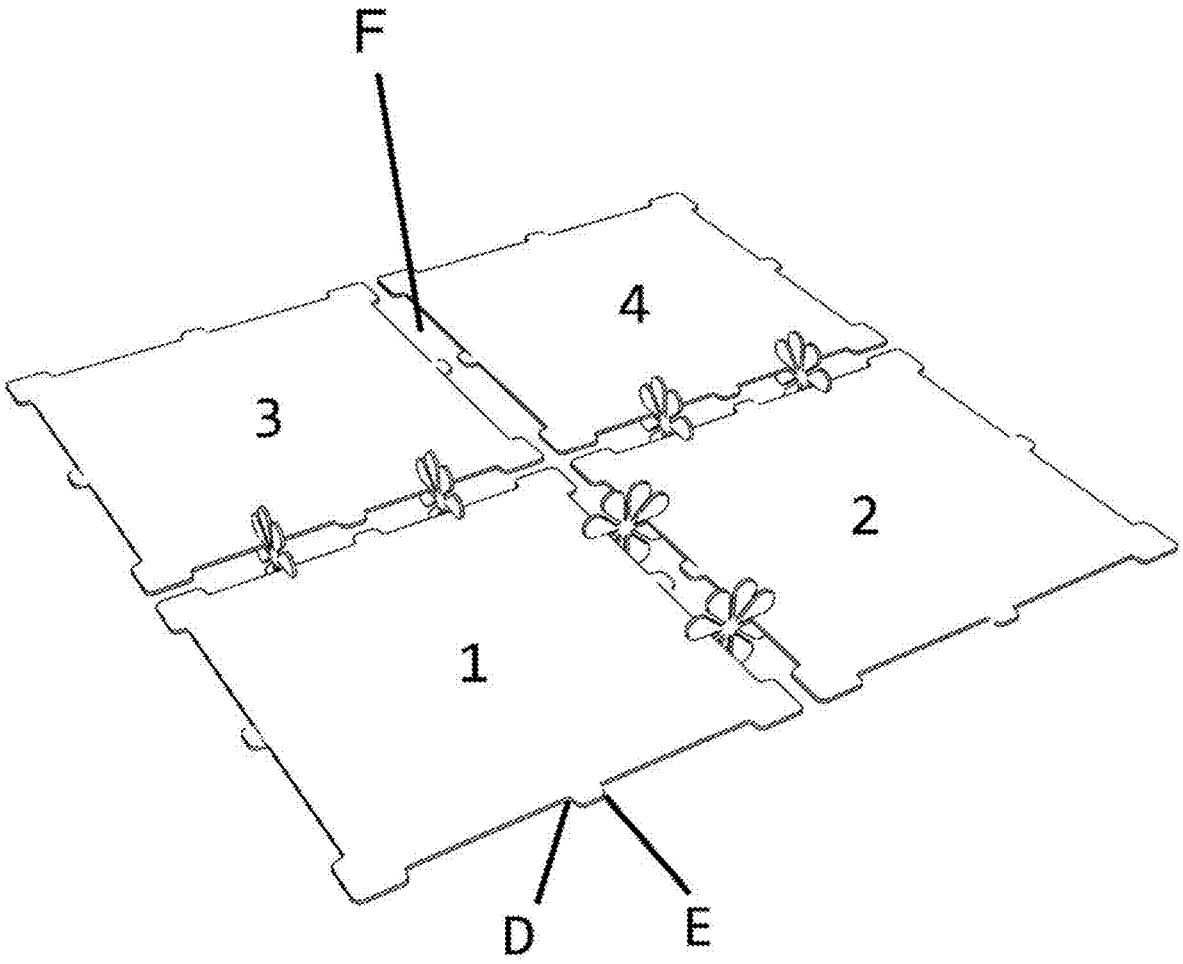
Fig. 2: View depicting the "Problem of the 4th Planar Element"

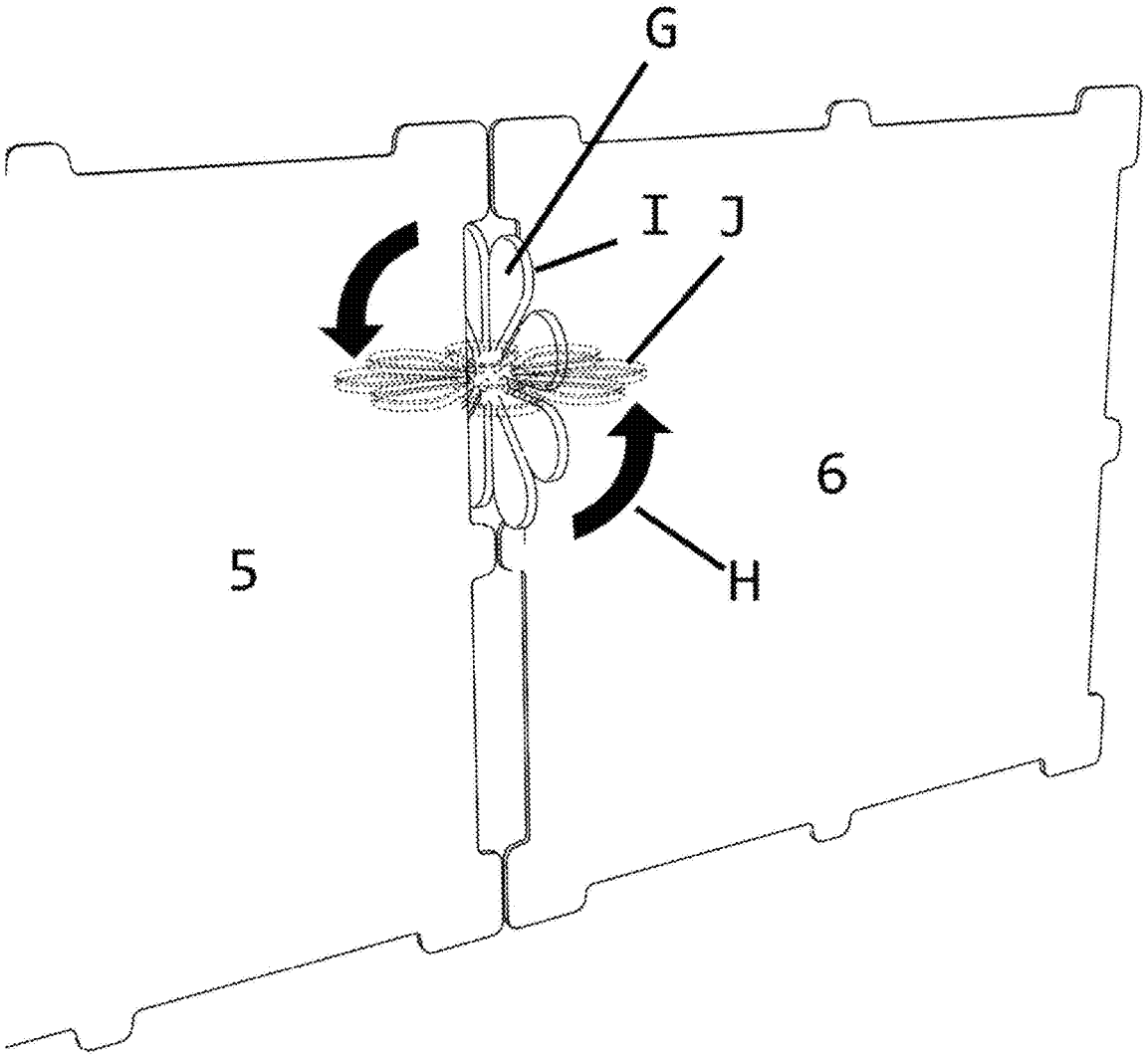
Fig. 3: View depicting the rotating action of the ""Turn-Key"" design

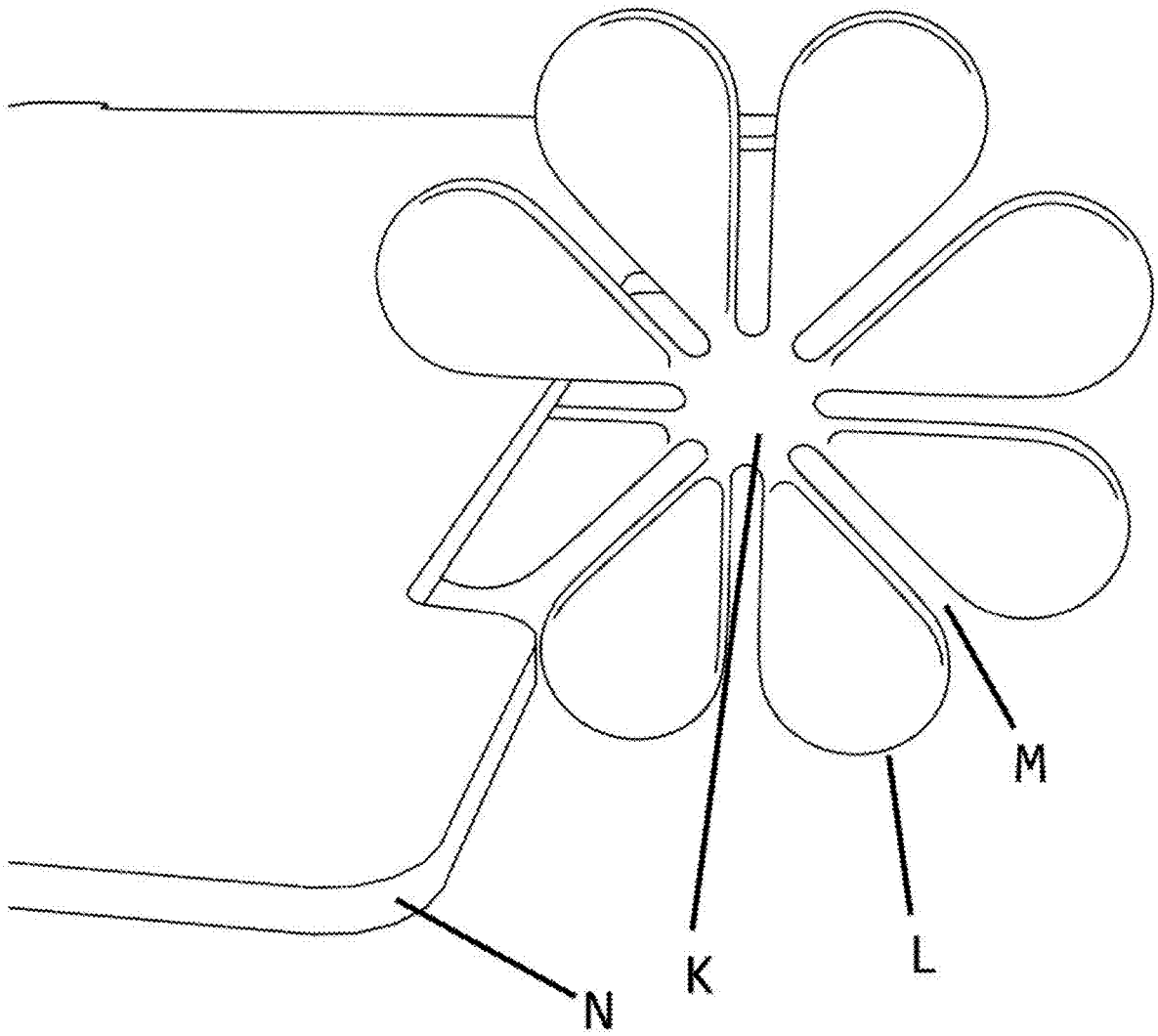
Fig. 4: View depicting how Connecting Element slots slip onto Planar Element

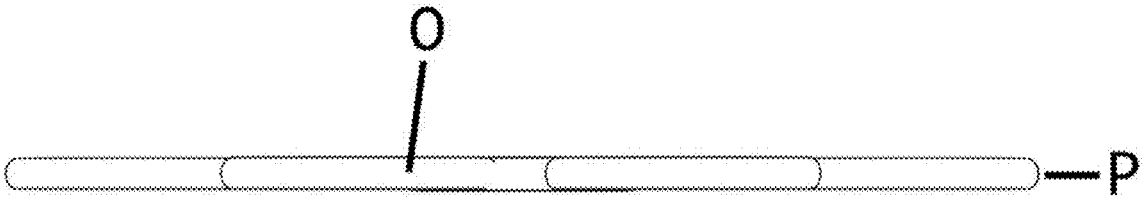
Fig. 5: Edge view of Connecting Element to depict rounded edge of said element

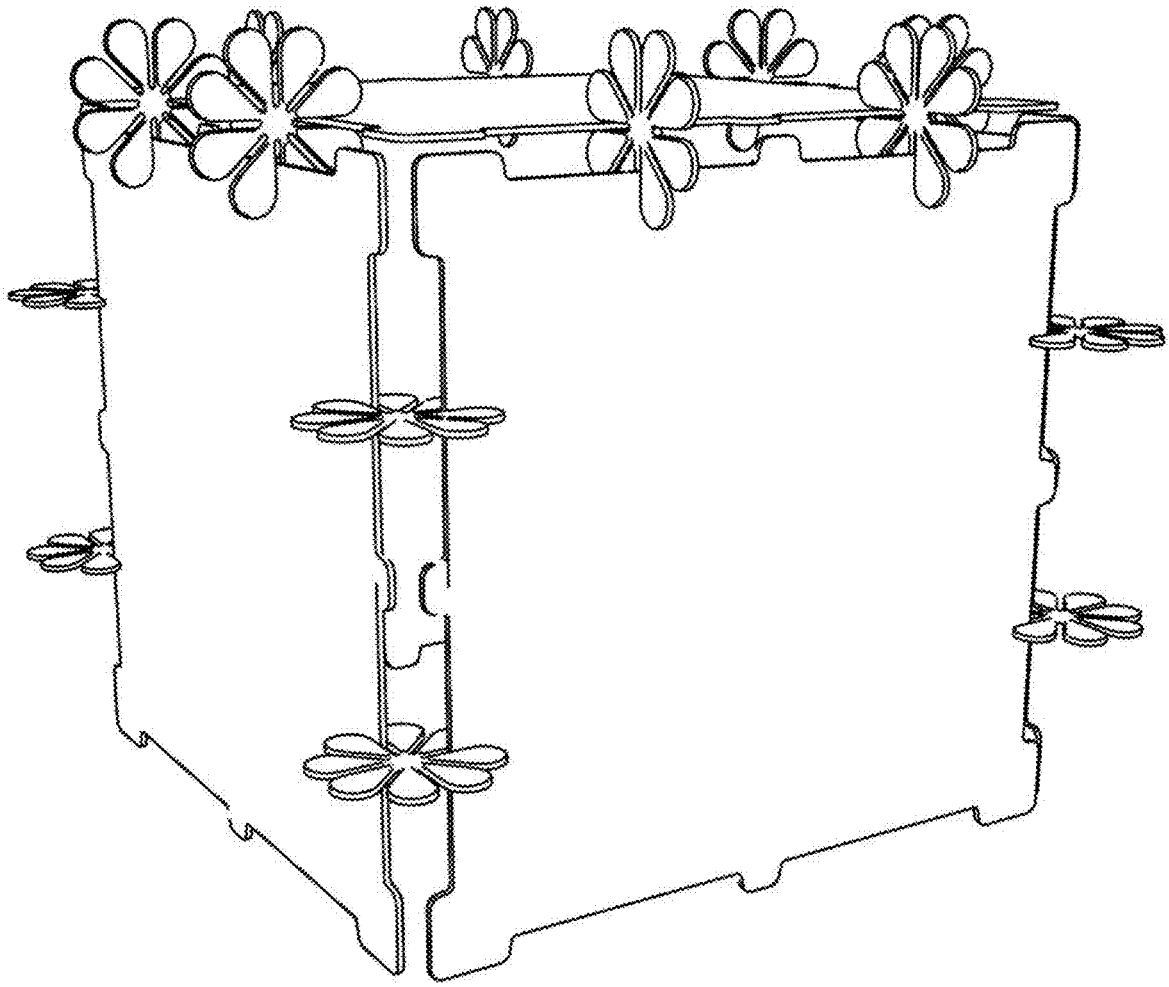
Fig. 6: View depicting 3-dimensional assembly using the ""Turn-Key"" design

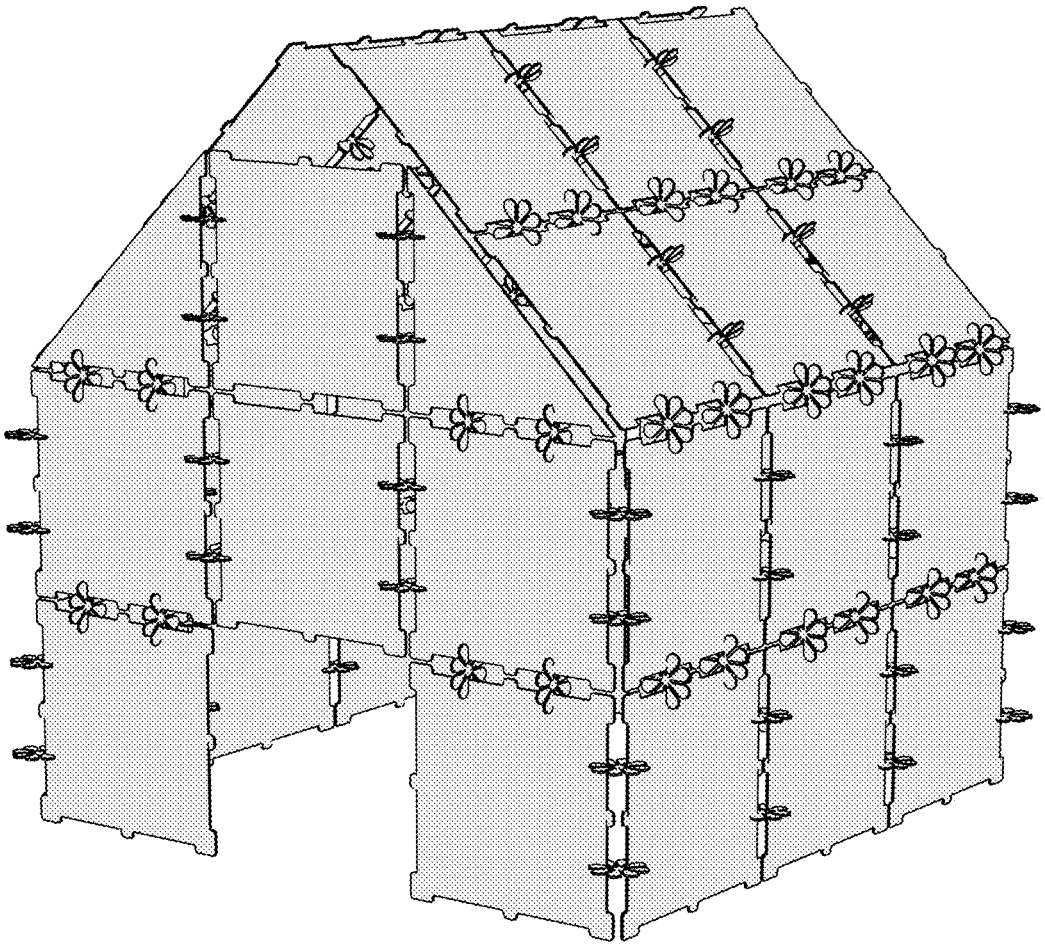
Figure 7: View depicting a finished structure using ""Turn-Key"" design

TURN-KEY DESIGN FOR CONNECTING A PLURALITY OF PLANAR SURFACES

Current U.S. Class: 52/578; 52/582.1; 446/85; 446/127; D21/491; D25/159

Current CPC Class: A63H 33/06; A63H 33/08; A63H 33/106; A63B 9/00

Current International Class: A63H 33/04; A63H 33/08; A63H 33/10; E04C 2/00

CROSS REFERENCE TO RELATED APPLICATIONS
U.S. Patent Documents

| | | |
|---|---|---|
| 1,398,852 | November 1921 | Gilbert |
| 1,426,087 | August 1922 | Metcalfe |
| 2,708,329 | May 1952 | McKee |
| 3,066,436 | December 1962 | Schuh |
| 3,177,611 | December 1965 | Beck |
| 3,477,188 | November 1969 | Kostick |
| 3,537,706 | November 1970 | Heavener |
| 3,561,757 | February 1971 | Schillig |
| 3,564,758 | February 1971 | Willis |
| 3,687,500 | August 1972 | Silvius |
| 3,729,881 | May 1973 | Disko |
| 3,747,262 | July 1973 | Endres |
| 3,827,177 | August 1974 | Wengel |
| 3,854,259 | December 1974 | Lechene |
| 3,855,748 | December 1974 | Thomas |
| 3,955,510 | May 1976 | Kinik |
| 4,212,130 | July 1980 | Walker |
| 4,257,207 | March 1981 | Davis |
| 6,595,825 | July 2003 | De Wilde |
| US 2007/0051055 (Prov. App.) | March 2007 | Lin |
| US 2009/0298385 (Prov. App.) | December 2009 | Brinckerhoff |
| US 2010/0285718 (Prov. App.) | November 2010 | Stone |

Existing unpatented product: http://www.hearthsong-.com/16-piece-large-scale-habitadule-construction-pieces.htm Foreign Patents

| | | |
|---|---|---|
| 140329 | September 1919 | GB |
| 571159 | August 1923 | FR |
| 49,313 | April 1940 | NL |
| 266,913 | February 1950 | CH |
| 1,243,060 | April 1960 | FR |

BACKGROUND OF THE INVENTION

When building structures or objects made of a plurality of planar elements, it is necessary to have some sort of apparatus to connect the elements. As early as 1921 (U.S. Pat. No. 1,398,852,) and as recently as 2010 (US 20100285718 A1), toy makers have searched for ways to enable children to make temporary play structures and objects by connecting a plurality of planar elements. Some construction toys have used connecting elements that attach one tubular element to another to create a structure or object upon which flexible material can be draped to create a semi-enclosed space (US 20100285718 A1). Other toys have connecting elements that use slots to take advantage of simple physical properties such as friction and, in some cases, compression to connect rigid planar elements (U.S. Pat. Nos. 3,066,436; 3,177,611; 3,477,188; 3,537,706; 4,257,207). Similar solutions have used two-ended connectors or tabs (U.S. Pat. Nos. 1,426,087; 2,708,329; 4,212,130) to connect these rigid planar elements.

Prior art designed to connect rigid planar elements work—to a point. They are sufficient when connecting a first planar element to a second planar element, and then connecting the first planar element to third planar element. The problem arises when connecting a fourth planar element to the second and third planar elements in a grid pattern as you might use when constructing a wall. (See FIG. 2)

Using this prior art to connect the fourth planar elements to the second and third planar elements creates what might be considered the "Problem of the 4th Planar Element." To use previous art to attach said fourth element as the last unit of 4-piece grid pattern, the user must push the edges of the fourth planar element onto connectors mounted on the edge of the second and third planar elements.

The heart of the problem with previous art is that it is very difficult—if not impossible—to connect this fourth rigid planar element by pushing it in two directions at the same time directly down onto a second planar element and, simultaneously, directly to the side onto a third planar element whose edge is at 90 degrees from the edge of the second element. Harder still is to do so without bending and distorting the edges of the second, third, or fourth elements, and without completely frustrating the child—or the doting parent—trying to create the structure or object.

Previous art, such as U.S. Pat. Nos. 1,426,087 and 3,827,177 include images of structures constructed using connectors, but if you imagine trying to build the structures represented, you will see that such assembly would be very difficult for the reasons stated above. Some prior art, such as U.S. Pat. No. 3,855,748, is more honest: The images included in this patent doesn't ever try to show that larger structures could be assembled using the invention because it simply would not be possible.

The result of these earlier, limited approaches to connecting multiple planer elements is that users are limited to created smaller, less complex, and more static structures or objects. It is impossible to know if the creators of previous art ever watched children try to create structures or objects using their designs. If they had done so, they would have seen that their approaches create a study in frustration. In addition to the frustration, users would find that trying to create structure with these approaches quickly degrades the parts themselves. Furthermore, the structures and objects created with prior art would be difficult to alter or reconfigure without taking the entire structure or object apart and starting from scratch.

BRIEF SUMMARY OF THE INVENTION

The "Turn-Key" design that is the subject of this patent application fully solves the "Problem of the $4^{th}$ Planar Element." What is unique and new about this invention is the ease with which the planar elements can be connected to each other. When there is not room enough to position a Connecting Element between two Planar Elements and simply press them together, the user starts by simply inserting a Connecting Element into the gap tooled into the edges of the Planar Elements. He or she then aligns the slots located 180 degrees apart on the Connecting Element, with the edges of the adjacent planar elements, and rotates the Connecting Element such that the slots in the connecting element travel across the surfaces of the Planar Elements.

The friction and compression created in the act of rotating the Connecting Element serves to firmly connect the two Planar Elements. This process can be repeated a plurality of times with a plurality of Connecting Elements and Planar Elements to create large structures and objects—the shape of which is completely up to the imagination of those using the construction set. The same process can be reversed to take apart the entire structure—or only portions of the structure or object—such as one might do to create an opening to serve as a window or door to the outside, or to a new "addition" to the existing structure.

The motivation for the first embodiment was an experience I had when my daughter was 5 years old. I wanted to create some kind of place for her to play in behind our house. There were grandiose backyard play sets for $5,000 and there were used refrigerator boxes—and very little in between. I chose the box route, which worked fine, but it was so hard to get rid of this huge, thick-walled box. And there was no way to store it. Rain, sleet, or snow, it stood forlornly out in the back yard, slowly sagging. When it had fallen apart, I had to use a skill saw to cut it into small enough pieces to fit it in the recycling container. Fast forward ten years and here is a toy that I think many children—and many parents and teachers—will appreciate.

My goal was to create a functional construction toy set children could use to easily create play things large enough to play "in." Many toys on the market, such as Legos and log-cabin type sets, enable children to create structures they can play "with." I was bedeviled by the "Problem of the 4$^{th}$ Planar Element" for years, until the idea of using "a gap, and connector capable of rotating inside the gap" slowly emerged from my prototypes.

By integrating this "Turn-Key" design with a plurality of atypically large toy elements, children will be able to build an unlimited variety of large play structures which they can then crawl or walk into and play inside of—both indoors and outside. Unlike a refrigerator box, these structures can be easily disassembled and stored in a small space. The same "Turn-Key" design that makes these play structures possible can be applied to other embodiments, as described further below.

Prior-art construction toy sets dating back to almost the start of the 20$^{th}$ Century have attempted to give children the ability to create large structures and objects. When I first did a patent search I was crestfallen to see that so many others had the same general idea as I did. Then I realized that none of these "Prior Arts" are in the market place. One possible exception, the "Habitadule," (http://www.hearthsong.com/16-piece-large-scale-habitadule-construction-pieces.htm), came the closet. Its problem was that it was made of inferior materials, and follows in the steps of earlier inventors who repeat the same mistake over and over again—that of never noticing that their approach doesn't actually work in the real world.)

The "Turn-Key" idea is particularly relevant today as parents and teachers search for ways to engage students in "STEM" (Science, Technology, Engineering, and Math) or "STEAM" (Science, Technology, Engineering, ART, and Math) skills.

On one level, a construction toy set that incorporates the "Turn-Key" design enables children to quickly assemble and play inside all manner of play structures (houses, forts, rockets, castles, etc.) and objects (tables, counters, desks, etc.). On another, higher level, these same toy sets give children an opportunity to develop a sense of spatial awareness, the ability to manipulate objects in three dimensions, a basic understanding of the laws of geometry, practical engineering experience in planar self-supporting structures and objects, and an ability to design and build structures and objects given a finite supply of construction elements.

The embodiment also enables children to work together toward a common goal. In a world where children often engage in isolated virtual play on digital devices and over the Internet, a construction toy set that incorporates the "Turn-Key" design enables children to work together to build three-dimensional structures and objects—the design of which is limited only by their imaginations. The more children come together with their individual toy sets, the larger and more complex and mentally challenging are the structures and objects they can create.

Because of the "Turn-Key" design, planar elements can be easily removed from the structure or object to create new design possibilities. By simply rotating the connecting element to release the two planar surfaces, users can quickly add new elements to the existing structure.

An additional benefit of this design is that after a structure or object has been built and enjoyed, it can quickly and easily be taken apart into its constituent planar and connection elements and compactly stored away. This is true whether the design is used to connect full sheets of marine plywood to create a storage structure or of plastic cardboard to make a play fort. In the first embodiment described below, this "compactability" can be very helpful for families with limited play or storage space inside the home or apartment. The materials from which the first embodiment is made are completely waterproof, so children can build structures outside without concern for rain or, to some extent, snow.

The embodiments described after the first embodiment envision the same combination of planar and "Turn-Key"-enabled connector elements being used to create a broad range of structures and objects. This range is defined by the choice of materials from which the planar and connecting elements are made. Large, more structurally sound materials can be used to create large permanent or semi-permanent structures or objects, all of which can be readily assembled and then, if and when the situation demands, just as quickly and easily be taken apart and stored compactly for subsequent reuse. Depending on the scale of the planar and connecting elements, and the materials from which they are made, the resulting structures could be used as storage sheds, outdoor shade structures, lightweight structures to provide protection from wind and sun at the beach, and similar uses.

BRIEF DESCRIPTION OF THE SEVERAL VIEWS OF THE DRAWING

FIG. 1: View depicting the gap formed by cutouts in the Planar Elements;

FIG. 2: View depicting the "Problem of the 4$^{th}$ Planar Element";

FIG. 3: View depicting the rotating action of the "Turn-Key" design;

FIG. 4: View depicting how Connecting Element slots slip onto Planar Element;

FIG. 5: Edge view of Connecting Element to depict rounded edge of said element;

FIG. 6: View depicting 3-dimensional assembly using the "Turn-Key" design;

FIG. 7: View depicting a finished structure using "Turn-Key" design

DETAILED DESCRIPTION OF THE INVENTION

First Embodiment: Integrated into Children's Toy Construction Set

Detailed Description of First Embodiment—FIGS. 1-6

In this embodiment, the shape and size of the two elements (Planar Elements and Connecting Elements) were chosen for a combination of lightness, rigidity, and ability of the intended audience to easily position and connected the elements. The intended audience for this embodiment is children between 6-12 years of age, however people younger or older as well as those with developmental or physical challenges or limitations may benefit from the embodiment as well.

The Planar Element

In this embodiment, a single Planar Element is initially identified as FIG. 1 A and is constructed of. 162-inch-thick corrugated plastic. Other similarly flat, rigid materials such as cardboard, utility board, Masonite, plywood, metal, and various types of polycarbonate, plastic, Plexiglas, or composite materials may be suitable for these Planar Elements, though each brings with it its own shortcomings.

Using a die cut designed and built specifically for this purpose, the Planar Elements are cut into what may be 15½-inch squares. However, these Planar Elements may be different polygon shapes such as rectangular, triangular, circular, etc. and made of materials such as plywood, polycarbonate, clear Plexiglas or similar plastics, cardboard, aluminum, steels, and existing or future flat, rigid materials. The Planar Elements have a specific edge treatment designed to facilitate the "Turn-Key" design. The die may be designed such that along each edge of the Planar Elements, sections of the material are removed (referred to in this patent application as "cutouts"). The cutouts (FIG. 1 B) may be approximately 5-inches long and 13/16-inch wide. However, the dimensions of these cutouts could change depending on the material used and the shape, material, and size of Connecting Elements that connect the Planar Elements. In all embodiments, the cutouts in one Planar Element will work best when they align with the cutouts in other Planar Elements (FIG. 1 C).

The cutouts are positioned equidistant from the center of each Planar Element's edge. The die used to form the cutouts is designed such that all resulting interior corners (FIG. 2 D) are cut using a ⅛-inch radius. All outside corners are cut with a ¼-inch radius (FIG. 2 E). This corner treatment removes sharp edges that might otherwise injure the intended audience, or degrade the structural integrity of the elements themselves.

In this embodiment, said cutouts along the edges of the Planar Elements are 5-inches long to accommodate the 4½-inch in diameter Connecting Elements (FIG. 3 G). The extra ½-inch provides ample room for a single Connecting Element described below to be inserted into the gap formed by the cutouts of two adjacent Planar Elements. Each cutout is 13/32-inch wide because when the two Planar Elements to be connected are placed next to each other, the combined width of the gap formed by the two cutouts slightly exceeds the ¾-inch diameter of the central hub (FIG. 4 K) of the Connecting Elements. This width provides sufficient room for the Connecting Element to rotate inside the gap and connect the two adjacent Planar Elements.

The corrugated plastic used for the Planar Elements in this embodiment is light, sufficiently rigid, easy to die cut, waterproof, and relatively inexpensive. Previous art used materials that were either not waterproof at all, such as corrugated cardboard (U.S. Pat. No. 4,212,130 and http://www.hearthsong.com/16-piece-large-scale-habitadule-construction-pieces.htm) or too heavy for young users to safely manipulate (U.S. Pat. No. 3,855,748).

Planar Elements may be designed in a wide variety of shapes to be used in a planar form or to be folded or otherwise manipulated to create a specific kind of structure, such as one representing a specific historical architectural style, such as "Victorian" or "Craftsman"-inspired Planar Elements, or Planar Elements can could be designed to create specific kinds of structures such barns, forts, or rockets (using the "Turn-Key" slots positioned at 45 degrees to each other). Planar elements can also be designed such that, in combination with Connecting Elements with slots placed at the necessary angles, the two can be combined to create geodesic shapes such as domes. Planar Elements can also be implemented with electronic, digital, or future devices such as required to collect solar energy to operate lights and/or fans embedded in the Planar Element.

The Connecting Element

The size of the Connecting Elements in the first embodiment was designed to accommodate the hand size and hand strength of the intended audience of 6-12 year olds. These elements are created using injection molding, a process in which a combination of plastic resins that are heated and injected together into a metal mold designed and built specifically for this purpose. The resins used to create the Connecting Elements are made of recycled—and recyclable—plastic, however other kinds of plastic resin can be used to create these elements. The Connecting Elements feature slots that radiate from a ¾-inch diameter central hub (FIG. 4 K) to that same Connecting Element's out edges (FIG. 4 L).

In this embodiment, the slots (FIG. 4 M) are positioned every 45 degrees along the outer circumference of the Connecting Element. Each slot is 0.150 wide, which is 0.12 inches narrower than the 0.162 thickness of the corrugated plastic sheeting (FIG. 4 N) used to make the planar elements. The slightly narrower width enables the Connecting Element to slightly compress the corrugated plastic to create a stable connection between the Connecting Element and the Planar Element. The thickness of the Connecting Elements (FIG. 5 O) is approximately the same thickness as the Planar Elements (0.162 inches), even though they are manufactured in a different way and from different materials.

The Connecting Elements are made using injection molding so that the edges of the slots featured on these elements can be rounded (FIG. 5 P). It would have been much less expensive to die cut the Connecting Elements from that same corrugated plastic used to manufacture the Planar Elements. This method, however, would have resulted in connecting elements with much less resiliency and durability, and would have resulted in Connecting Elements with perpendicular, rather than rounded, edges—which would have a major impact on ease of use.

As determined by repeated testing, it is very difficult to initiate the rotation movement (FIG. 3 H), which is at the core of the "Turn-Key" design, when the perpendicular edge of a die-cut Connecting Element slot comes into contact with the perpendicular edge of a Planar Elements die cut from the corrugated plastic sheeting (or from any rigid planar material). This is because the perpendicular edge of the Connecting Element gets caught or "hung up" on the perpendicular edge of the Planar Element cutouts as the Connecting Element begins to rotate across the surfaces of the Planar Elements.

When the edge of the Connecting Element is rounded, as is made possible by injection molding, it is quite easy to initiate this rotating movement. The rounded edges enable the slots of the Connecting Element to travel smoothly past the Planar Element's perpendicular edge and across the Planar Element's surface.

Because injection molding manufacturers have access to a great variety of molding plastic resins, the use of this method also allows great flexibility in choice of colors and tensile properties of the Connecting Elements. These plastic resins can be mixed to achieve a wide range of Connecting Element characteristics, specifically with regard to the properties of color, tensile strength, flexibility, and recyclability.

Operation of First Embodiment (FIGS. 2 and 3)

In Background—Prior Art, we referred to the "Problem of the $4^{th}$ Planar Element." This problem is depicted in FIG. 2. As can be seen in this figure, it is possible to place Connecting Elements on the first Planar Element (1) and then press the second Planar Element into slots on the opposite side of the Connecting Element. The same is true when you want to connect first Planar Element (1) to the third Planar Element (3). The problem comes when you then want to connect the fourth Planar Element (4) to said Planar Elements 2 and 3 in order to build a larger structure. With the second Planar Element (2) connected to the fourth Planar Element (4), it is not possible to insert connectors between Planar Elements 3 & 4 without bending or twisting Planar Elements 3 and/or 4 to make room for the Connecting Elements.

The solution, never suggested in previous art and as seen in FIG. 3, is to insert the Connecting Element (FIG. 3 G) vertically into the gap between two planar elements (FIGS. 3 5 & 6). Once the Connecting Element is in the cutout between the two Planar Elements, the user aligns the slots that are 180 degrees apart on the Connecting Element, and then rotates the Connecting Element is rotated from its BEFORE position (FIG. 3 H) by approximately 90 degrees to its AFTER position (FIG. 3 I). Once in the AFTER position, the Connecting Element uses friction and compression inherent to hold the two Planar Elements (FIGS. 3 5 & 6) together.

By repeating this process, it is possible use any number of Connecting Elements to securely connect any number of Planar Elements. The only limitations are the number of Connecting Elements and Planar Elements available, and the strength of the material from which Planar Elements are made. Note that as in FIG. 6 and FIG. 7, it is possible to use different slots on the Connecting Elements (FIG. 4 M) to connect Planar Elements at 180 degrees, 90 degrees, or 45 degrees. Indeed, it is possible to build an essentially rounded structure by connecting a series of planar elements using only the 45-degree slots on the Connecting Elements.

As noted above, the "Turn-Key" design makes it very easy to completely disassemble a structure, or to remove specific Planar Elements from a structure in order to change the shape of the structure, such as to create "windows" or "doors" by removing one or more Planar Elements, or to add new Planar Elements in new positions relative to the existing structure. And the first embodiment can be stored in a small space. When the child wants to build a structure, she or he can take the box out of a closet or storage area, quickly build and play in a large structure, and then just as quickly take it down and store it away again. In earlier days, kids might have uses sofas, blankets, and pillows to make "forts" in the middle of the living room—much to the chagrin of the parents, who had to return the room to some semblance of order afterwards.

This concern for sufficient play space also guided the choice of materials for this embodiment. As previously mentioned, both the corrugated plastic sheeting used for the Planar Elements and the injection-molded plastic used for the Connecting Elements are completely waterproof. Children who don't have enough room to build structures indoors—or who simply want to get some fresh air—can build them outdoors.

The ease of connecting a plurality of Planar Elements, made possible by the present "Turn-Key" design, supports a young child's natural desire and ability to build things. Depending on their skills and preferences, the child or children involved may follow plans that come with the toy set to guide them in the construction of specific structures. They can also choose to simply follow their intuition and imagination to create unique structures. And the toy provides an excellent opportunity for parents (and teachers) to interact with children to help them realize their structural ideas. The toy enables children to learn the advantages of pooling their resources to build ever-larger structures. They can put into practice elementary geometry concepts and, because the resulting structures can be quite large, can practice cooperation, leadership, and other social skills.

Second Embodiment

Where the first embodiment is designed for children to use to create play structures and objects using materials that are light, but rigid, the same "Turn-Key" design can be applied to create larger and more resilient structures. (Imagine quick-to-assemble shelters to be used for temporary storage or shelter from the elements.)

In this second embodiment, the scale and nature of the elements would have to change. For instance, the Connecting Elements for this embodiment would not only have be made in a size appropriate for the size of the embodiment's Planar Elements, but rigid enough to withstand the rotational force that would be exerted on them to rotate them into position for the purposes of connecting adjacent Planar Elements. (Imagine Connecting Elements made of steel to connect Planar Elements made of sturdy plywood.)

Operation of Second Embodiment

To create more permanent structures or objects using the "Turn-Key" design, a plurality of large planar elements can be connected using a plurality of durable connecting elements. Of course, it would not be possible to simply scale up the elements to realize the practical applications suggested by the second embodiment. For instance, in order to rotate much larger Connecting Elements into position, it may be necessary to design and build a tool for this specific purpose. Said tool would fit over the exposed portion of the Connecting Element and extend out from said element to provide sufficient leverage and torque to rotate the Connecting Element. Furthermore, if these larger structures needed to be waterproof or water-resistant, some form of gasket may need to be devised such that when it is inserted into the gap between Planar Elements it creates a waterproof or water-resistant seal. And because of the linear force that will be generated when the Connecting Elements are rotated into position, the Planar Elements may well need to be secured in place so that they don't move away from each other as the Connecting Element is rotated into position.

When the Planar Elements are made of denser, heavier materials, it may be necessary to create additional implements to overcome friction and allow the Connecting Elements to be rotated into position and to hold in position the Planar Elements to be connected.

Additional Embodiment

Planar elements in a variety of dimensions can be constructed from plywood, corrugated materials, sheetrock, metal, composite, or other similarly rigid and structurally sound existing or imagined materials to create a range of permanent or semi-permanent structures.

In such embodiments, the Connecting Elements can be constructed of similarly resilient materials such as plastic, acrylics, wood, metal, composites, carbon fiber, or any existing or future materials. They can be created using injection molding, water cutting, forging, 3-D printing or any other existing or future process that results in Connecting Elements capable of performing as described in this application.

In more construction-based embodiments, the shape of the Connecting Elements and the width of the slots can need to be changed to meet the specific design needs of the materials used and the structural goals to be achieved. The overall dimensions of the Planar Elements, including length, width, depth, can change as needed to meet the goals of the intended structure.

In all of these embodiments, the "Turn-Key" design would be an essential part of their overall design and creation.

CONCLUSION, RAMIFICATIONS, AND SCOPE

The reader will see that the "Turn-Key" design provides a way to connect a plurality of Planar Elements that is easier, faster, more easily adjusted, and more economical than expressed in Prior Art. Children's constructions sets that implement the "Turn-Key" design can be used by children approximately between 6-12 years of age, as well as by people younger or older and those with developmental or physical challenges or limitations. They can create an endless variety of large, stable structures of a size that enables children to play "in" the structures or objects rather than just "with" them.

While the above descriptions of the embodiments contains many specifications, these should not be construed as limitations on the scope of possibilities for the "Turn-Key" design, but rather as an exemplification of several embodiments thereof. The creation of many other variations are possible, such as those achieved by "scaling up" the Planar and/or Connecting Elements as demonstrated to quickly construct larger, more permanent or semi-permanent structures. To achieve these large structures or objects, the Connecting Elements can be constructed using appropriate current or future manufacturing techniques using virtually any materials that enable to creation of rigid, stable planar sheets for the Planar Elements and any materials that create rigid-but-flexible Connecting Elements capable of performing as described herein.

Accordingly, the scope should be determined not by the embodiments listed, but by the appended claims and their legal equivalents. Although the embodiments disclosed herein are for purposes of illustration, is will be understood that various changes, modifications, and substitutions may be incorporated in such embodiments and the elements that make them up without departing from the spirit of the invention.

DRAWINGS

Reference Numbers

FIG. 1 A: Planar Element

FIG. 1 B: Gap between Planar Elements, formed by "cutouts," into which Connecting Element will be inserted and then rotated (see FIG. 3)

FIG. 1 C: Aligned edges of two cutouts

FIG. 2 D: Interior edges of Planar Element cutout

FIG. 2 E: Exterior edges of Planar Element cutout

FIG. 2 F: Gap between Planar Elements formed by alignment of two "cutouts"

FIG. 2 1, 2, 3, 4: Four Planar Elements

FIG. 3 G: Connecting Element

FIG. 3 H: Arrow indicating direction of Connecting Element rotation

FIG. 3 I: Position of Connecting Element BEFORE ""Turn-Key"" rotation

FIG. 3 J: Position of Connecting Element AFTER ""Turn-Key"" rotation

FIG. 3 Numbers 5, 6: Two Planar Elements

FIG. 4 K: Hub at center of Connecting Element

FIG. 4 L: Outer edge of Connecting Element

FIG. 4 M: Slot in Connecting Element

FIG. 4 N: Thickness of Planar Element

FIG. 5 O: Thickness of Connecting Element

FIG. 5 P: Rounded edge/radius of Connecting Element

What is claimed is:

1. A method of building play structures comprising the steps of:

providing a plurality of polygonal shaped panels each having a plurality of outer edges, wherein each outer edge includes an indentation with a length extending along the outer edge;

providing a plurality of connectors each having a plurality of radially extending slots arranged in opposing pairs, wherein each pair of slots is aligned along an axis;

placing an outer edge of a first panel of the plurality of panels adjacent to an outer edge of a second panel of the plurality of panels such that the outer edge indentation of the first panel is aligned with the outer edge indentation of the second panel to form a gap with a longitudinal axis between the first and second panels;

inserting a connector of the plurality of connectors within the gap in a first orientation such that the axis of a pair of slots is aligned with the longitudinal axis of the gap; and the connector from within the gap to a second orientation such that the axis of the pair of slots is perpendicular to the longitudinal axis of the gap to cause one slot of the pair of slots to frictionally engage with the first panel and the other slot of the pair of slots to frictionally engage with the second panel to attach the first and second panels together.

2. The method of building play structures according to claim 1 further comprising the step of:

rotating the connector within the gap attaching the first and second panels together back to the first orientation to disconnect the first and second panels.

* * * * *